US009132055B1

(12) United States Patent
Wallace

(10) Patent No.: US 9,132,055 B1
(45) **Date of Patent: *Sep. 15, 2015**

(54) ATHLETIC MASSAGE DEVICE

(71) Applicant: Carey M Wallace, Coldspring, TX (US)

(72) Inventor: Carey M Wallace, Coldspring, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/029,782

(22) Filed: Sep. 17, 2013

Related U.S. Application Data

(63) Continuation-in-part of application No. 12/986,585, filed on Jan. 7, 2011, now Pat. No. 8,758,280.

(60) Provisional application No. 61/293,340, filed on Jan. 8, 2010, provisional application No. 61/702,077, filed on Sep. 17, 2012.

(51) Int. Cl.
*A61H 7/00* (2006.01)
*A61H 1/00* (2006.01)
*A61H 15/00* (2006.01)

(52) U.S. Cl.
CPC ..... *A61H 1/00* (2013.01); *A61H 15/0085* (2013.01)

(58) Field of Classification Search
CPC ..... A61H 1/00; A61H 7/00; A61H 23/0263
USPC ..... 601/46, 49, 57, 58, 60, 61, 63, 65, 67, 601/69, 70, 72, 73, 80, 84, 86, 87, 94, 97, 601/98, 99, 101, 102, 103, 107, 110, 111, 601/112, 113, 134
See application file for complete search history.

(56) References Cited

U.S. PATENT DOCUMENTS

| | | | | |
|---|---|---|---|---|
| 5,577,995 | A * | 11/1996 | Walker et al. | 601/120 |
| 8,556,837 | B1 * | 10/2013 | Poirier | 601/46 |
| 8,758,280 | B2 * | 6/2014 | Wallace | 601/46 |
| 2007/0123808 | A1 * | 5/2007 | Rhoades | 601/73 |

* cited by examiner

*Primary Examiner* — Quang D Thanh
(74) *Attorney, Agent, or Firm* — Nick A Nichols, Jr.

(57) ABSTRACT

An athletic massage device is described with improved pressure absorption and distribution, along with methods for using the same. The athletic massage device may comprise one or more massage rollers covered by one or more layers of pliant material, which allow a user improved control over how to adjust applied pressure. In some embodiments, devices are provided with a deep core construction with a pliant outer perimeter. A hard spine may house a motor and rechargeable battery to create vibrations, which may be adjustable. An inner core layer of a pliant material may overlay the spine. An outer surface layer of a more pliant material may overlay the inner core. Protrusions from the spine may extend into the inner core layer to improve pressure or energy transmission. Embodiments may be provided in the form of balls, massage sticks, rolling pins, or dumbbells. A docking station may provide a recharge connection and storage for the massage rollers.

16 Claims, 8 Drawing Sheets

ATHLETIC MASSAGE DEVICE

CROSS-REFERENCE TO RELATED APPLICATIONS

This application is a continuation-in-part of U.S. patent application Ser. No. 12/986,585, filed Jan. 7, 2011, which is herein incorporated by reference. This application claims benefit of U.S. provisional patent application Ser. No. 61/702,077, filed Sep. 17, 2012, which is herein incorporated by reference.

BACKGROUND OF THE INVENTION

1. Field of the Invention

Embodiments of the present invention generally relate to configurations of a massage device to enhance muscle recovery after athletic exertion.

2. Description of the Related Art

When training or competing in sports, athletes undergo strenuous muscle exertions. Vigorous muscular activity results in buildup of lactic acid and other metabolites in muscle fibers. In addition, repetitive active contraction and passive stretching of muscle fibers during vigorous exercise may result in micro-trauma to the muscle fibers. Metabolic overload and micro-trauma result in tightening and contraction of muscles. This, in turn, impedes athletic performance.

Massage therapy expedites muscle recovery after vigorous exercise by activating certain vascular and neuromuscular pathways. Injured and exhausted muscles send pain messages to the spinal cord via small unmyelinated nerve fibers. Spinal reflexes further perpetuate and maintain this unwanted muscle contraction through motor efferents as a protective mechanism against further trauma. In accordance with the gate control theory of pain (See Jessell T M, Kelly D D: Pain and Analgesia, in Kandel E R, Schwartz J H, Jessell T M (eds): Principles of Neural Science, Third Edition, New York, Elsevier, 1991, pp 385-399, incorporated by reference herein), somatosensory stimulation and vibration during massage activate large myelinated nerve fibers that interrupt these unwanted reflexes by virtue of modulating the neurotransmitters in the spinal cord. As the motor commands from the spinal cord are suppressed, the contracted muscles are allowed to relax. This muscular relaxation improves vascular flow, which in turn allows better delivery of oxygen and nutrients and better washout of metabolites, thus expediting muscular recovery.

They key to the efficacy of athletic massage is sensory stimulation that is not perceived as painful by sensory receptors, thus preferentially activating the large myelinated nerve fibers that suppress the motor input to the muscles. While skilled massage therapists continuously adjust massage pressure to achieve this end, athletic massage equipment lacks the feedback mechanisms that would allow for such adjustments.

Existing massage equipment is typically made of a single material, such as wood or plastic, applying fixed pressure through a single hard surface at the point where the equipment contacts the skin. Furthermore, although some massage devices incorporate vibration stimulation, the vibration energy that is transferred through this single hard interface cannot be readily modulated. As such, the effectiveness of such equipment is limited.

Accordingly, there is a need for massage equipment that allows for easily adjusting the amount of pressure that is put on the body. There is further a need for a tool that athletes can use by themselves. Additionally, there is a need for massage equipment that better distributes energy and pressure to various body parts and that may be easily adjustable. Moreover, there is a need for massage tools that allow greater versatility of use within a single device.

SUMMARY OF THE INVENTION

Embodiments disclosed herein generally provide for athletic massage devices, with improved pressure absorption and distribution, and methods for using the same. The athletic massage devices may comprise one or more layers of pliant material, which allow a user improved control over how to adjust applied pressure or vibration energy. In some embodiments, devices are provided with a deep core construction with a pliant outer perimeter. The core may comprise a spine that houses a motor and rechargeable battery to create vibrations. Vibrations may also be adjustable. The spine may be made from a hard, light weight material such as aluminum or plastic or composites. One or more layers of one or more types of pliable material may substantially surround a portion of the spine. Layers may vary in pliability or in hardness. The spine(s) may have extensions such as fins or spokes which protrude through at least one of the pliable layers.

For example, there may be an outer surface layer of soft foam for making contact with the skin. Memory foam is a preferred material for the outer surface layer. The outer surface layer may substantially surround an inner core layer of a denser foam or rubbery material, which in turn may surround a hard spine. The spine may house an adjustable motor which allows a user to create adjustable vibrations. The spine may also have protrusions that extend radially from the spine into the inner core layer, so that the inner core may absorb and distribute vibration energy. Protrusions may be provided in different embodiments, such as fins or spokes.

Accordingly, the outer surface layer may be applied softly to the skin over a muscle with light pressure or light vibration. By applying additional pressure to the device, a user may apply pressure to the muscle from denser foam beneath the outer layer. Applying additional pressure to the device may allow for firmer pressure to be applied from the hard spine, while at the same time cushioning the muscle with one or more of the more pliant layers. The amount of cushioning may also be adjusted, such as by applying pressure to regions where one or more protrusions extend from the spine into the dense inner core. Thus, embodiments allow a user to have a large amount of control over pressure and/or vibration energy. Further, adjustable pressure may be applied over a wider range of areas with much more control than was previously available with other devices. Additionally, embodiments may be made in various configurations, such as balls, sticks, rolling pins or dumbbells and the like.

In one embodiment, an athletic massage device is provided for applying adjustable pressure, the device comprising: a spine made from a hard material, wherein the spine at least partially surrounds an interior space; an inner core layer made from a material that is more pliant than the spine, wherein the inner core layer at least partially surrounds the spine; and an outer surface layer made from a material that is more pliant than the inner core layer, wherein the outer surface layer at least partially surrounds the inner core layer. The athletic massage device may further comprise: at least one rechargeable battery; at least one vibrating motor, housed at least partially within the interior space of the spine; and at least one electrical connection. The electrical connection may be a female receptor adapted for electrical connection with a charging station. The athletic massage may further comprise a control interface to vary the level of vibration.

Additionally, the athletic massage device may comprise protrusions that extend radially from the spine into the inner core layer. The protrusions may also extend substantially through the inner core layer. Moreover, the pliant material of the inner core layer may comprise either a dense foam or rubbery material, and the pliant material of the outer surface layer may comprise soft memory foam.

Embodiments of the athletic massage device may be provided in various shapes. In some embodiments, the device may be substantially shaped like a ball, or a dumbbell, or a massage stick. The massage stick may also be configured as a rolling pin. For example, the athletic massage device may comprise a plurality of hand grips, wherein at least a portion of the massage stick is adapted to roll between the hand grips.

In another embodiment, an athletic massage device is provided for applying adjustable pressure, the device comprising: a first hand grip for a user to hold near a first end of the device; a second hand grip for a user to hold near a second end of the device; and a plurality of substantially cylindrical massage rollers or knuckles positioned between the first and second hand grips, each knuckle comprising: a spine made from a hard material, wherein the spine at least partially surrounds an interior space; and at least a first layer of pliant material that at least partially surrounds the spine. Additionally, each of the plurality of knuckles may rotate. Moreover, the spines of each of the plurality of knuckles may be connected to form a single piece that serves as a common spine for the plurality of knuckles. Further, each of the plurality of knuckles further may comprise a second layer of pliant material that at least partially surrounds the first layer of pliant material and that is more pliant that the first layer of pliant material. Each of the plurality of knuckles may also comprise protrusions that extend radially from the spine into at least the first layer of pliant material.

In additional embodiments, the athletic massage device for applying adjustable pressure may also comprise at least one rechargeable battery; at least one vibrating motor, housed at least partially within the interior space of one or more of the spines; and at least one electrical connection. The rechargeable battery may be housed at least partially within the second hand grip, and/or the electrical connection may be a female receptor in the second hand grip adapted for electrical connection with a charging station. Further, the athletic massage device may comprise a second vibrating motor, and/or a control interface to adjust the vibration level provided to the device from the combination of the first and second vibrating motors.

A method is also provided for applying adjustable pressure from an athletic massage device, the method comprising: providing an athletic massage device comprising a hard spine, a pliant inner core layer overlaying the spine, an outer surface layer overlaying the inner core layer that is more pliant than the inner core layer, and at least one vibrating motor within the device; applying the athletic massage device to a muscle; applying light pressure or light vibration to the muscle from the more pliant outer core layer; applying increased pressure or vibration to the muscle from the pliant inner core layer; and adjusting the vibration energy applied to the muscle from the vibrating motor. The method may further comprise distributing vibration energy evenly to the pliant inner core layer through protrusions from the spine that extend radially through at least a portion of the inner core layer.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended figures. It is to be noted, however, that the appended drawings illustrate only typical embodiments of this invention and are therefore not to be considered limiting of its scope, for the invention may admit to other equally effective embodiments.

DETAILED DESCRIPTION

Embodiments of the present invention discussed herein generally provide athletic massage devices, with one or more layers of pliant material, and methods for using the same. Embodiments provide for massage devices with improved pressure absorption and distribution, which may also allow a user improved control over how to adjust applied pressure. In some embodiments, devices are provided with a deep core construction with a pliant outer perimeter. The term "athletic" as used herein is not meant to limit users of the described massage device to athletes in competitive sports but is used generally by way of an example of a user that may benefit from massage therapy. Any user desiring massage therapy may benefit from using a massage device described herein.

Figure 1:
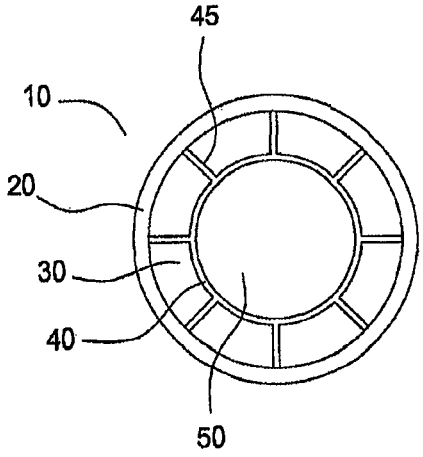
FIG. 1 depicts a cross-sectional view of a massage device according to one embodiment of the invention.
Figure 2:
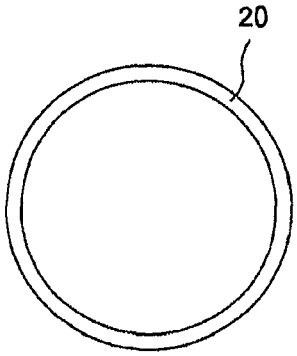
FIG. 2 depicts a cross-section view of an outer surface layer of a massage device according to some embodiments.
Figure 3:
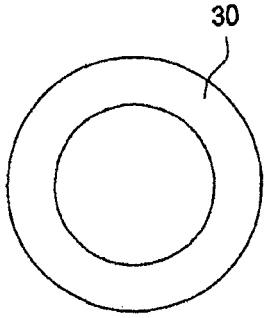
FIG. 3 depicts a cross-section view of an inner core layer of a massage device according to some embodiments.
Figure 4:
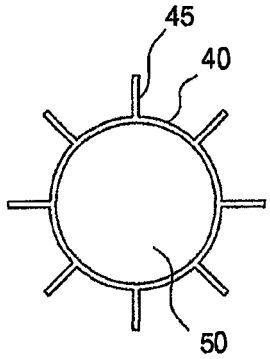
FIG. 4 depicts a cross-section view of a spine of a massage device according to some embodiments.

Referring first to FIG. 1, a section view of a massage device 10 is shown. The massage device 10 may define a spherical or ball configuration. FIGS. 2-4 provide cross-sectional views of components that may be incorporated in the massage device 10. It is to be understood that embodiments discussed herein may be applied in other configurations, such as in massage sticks or rolling pins or dumbbells or other configurations.

In FIG. 1, athletic massage device 10 comprises a deep core construction with layers of varying pliability. At the core of the device is a substantially spherical hollow core 40, which preferably comprises a hard, light weight material such as aluminum or plastic or composites. Core 40 may surround an interior space 50, which may serve as a housing for components that perform desired mechanical or electrical operations. For example, core 40 may house one more batteries, motors, wiring systems or controls for creating vibrations. Vibrations may be variable.

In the embodiment shown in FIG. 1, an inner layer 30 of resilient material overlays the core 40. The layer 30 may comprise a dense foam or rubbery material or the like. An outer surface layer 20 of pliant material overlays the inner layer 30, and comprises a material more pliable than the inner layer 30. For example, outer layer 20 may comprise a soft material such as memory foam for soft contact with skin.

Core 40 may also have protrusions 45, such as fins or spokes, which extend into one or more surrounding layers of resilient materials. Protrusions 45 may allow vibration energy to be transferred more efficiently or more evenly from the core 40 into the inner layer 30 and the softer outer layer 20 surrounding it. In FIG. 1, the protrusions 45 are pictured as extending through the inner layer 30 and contacting the inner surface of the outer layer 20. Other embodiments may provide protrusions 45 extending through and/or partially into one or more layers of pliable resilient material overlaying the inner layer 30. Protrusions 45 may also be used to determine or adjust how much vibration energy is transferred to different layers. For example, as shown in FIG. 1, the number and the length of protrusions 45 may determine how much energy is transferred into the inner layer 30. As shown in the embodiment of FIG. 1, the protrusions 45 may contact the outer surface layer 20 without extending into it so that less vibration energy is transferred to the layer 20. Accordingly, a user may apply more or less vibration energy for a given setting by applying more or less pressure to the device 10. Protrusions 45 may be made from the same material as the core 40, with the same hardness, or from different materials as desired. Protrusions 45 may also serve other purposes, such as anchoring the surrounding layers 20, 30 of the pliable resilient materials in position, and providing additional firmness and structural stability to the device 10.

FIGS. 2-4 illustrate cross-sections of components that may be incorporated in the massage device 10, viewed separately. FIG. 2 illustrates outer surface layer 20 as a continuous layer of pliable material overlaying the inner layer 30. FIG. 3 illustrates the inner layer 30 as a continuous layer overlaying the core 40. The thickness of the inner layer 30 may be greater than the thickness of the outer layer 20. FIG. 4 illustrates core 40 with protrusions 45 that may extend partially into one or more of the surrounding layers 20, 30. Other embodiments may provide layers of pliant resilient material that are not continuous. For example, in FIG. 1, if protrusions 45 comprise fins, the inner layer 30 may comprise strips of resilient material fixed on the core 40 between the respective fins 45. Further, even though FIG. 1 illustrates eight protrusions 45 evenly spaced in a cross-sectional view, there may be more or less protrusions 45 provided over the surface of core 40, and the protrusions 45 may be spaced in other desired configurations. Other embodiments may employ more or fewer layers of resilient material, or alternatively, may employ one or more layers of resilient material having different densities and pliability.

Embodiments in round shapes, such as a ball, may be used on areas of a user's body that are curved, for example, shoulders or knees, to help release the tissue or to help muscles get blood flow moving more freely. Balls may be designed in various sizes. Some preferred sizes may have a diameter of about 4-inches, 6-inches, 8-inches or 10-inches for use on various body types and various places. The outer surface layer 20 may have a thickness less than that of the inner layer 30 as depicted in FIGS. 2 and 3. For example, the inner layer 30 may have a thickness of about 2.5 to 3 inches. The outer surface layer 20 may have a thickness less than about 1 inch, such as about 0.25 inches.

Figure 5:
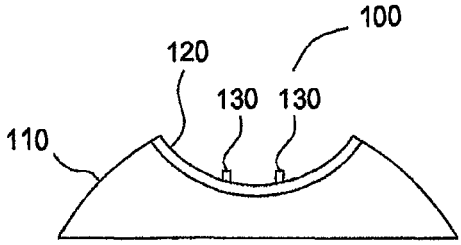
FIG. 5 depicts a side view of a message device charging station, according to some embodiments.

Additionally, the massage device 10 may include wire connectors or ports for connecting a rechargeable battery in the device 10 to a power source. For example, a female receptor may be provided in the device 10, or on its surface, for connection to a charging station. One embodiment of a charging station 100 is shown in FIG. 5. The charging station 100 may have a base 110 with an upper surface 120 adapted to receive the device 10. Connectors 130 may be adapted to provide an electrical connection to device 10. In the embodiment shown in FIG. 5, connectors 130 are depicted as male connectors for insertion into device 10. Charging station 100 may also be designed as an electrical plug without the base 110, for plugging into a wall outlet.

Embodiments disclosed herein provide improved pressure absorption and distribution over a large surface area. A user is also afforded greater control over how to adjust applied pressure and energy. For example, when device 10 is used to massage a muscle, a user may initially apply soft pressure so that the softer outer layer 20 of pliable material applies pressure to the skin. Accordingly, the muscle may initially be massaged more gently with light pressure or light vibration. Further, outer layer 20 may provide a softer contact surface for comfort. As the muscle begins to relax, the user may apply additional pressure so that pressure is exerted on the muscle from denser or harder material deeper within device 10. For example, the user may apply greater pressure on the massage device 10 so that pressure and/or more vibration energy is transmitted from the inner layer 30 to the massaged muscle or body tissue. Additionally, the user may apply even greater pressure on the massage device 10 so that pressure and/or vibration energy from the hard core 40 or the protrusions 45 may be transmitted to the massaged muscle or body tissue. Alternatively, the user may start by applying more energy to move a muscle or muscle group that is tighter, and adjust applied pressure or energy as desired or depending on the muscle's response. Outer layer 20 may also provide cushioning to the muscle while firmer pressure is applied. The amount of cushioning may also be adjusted, such as by applying pressure to regions where one or more fins or protrusions 45 protrude through the dense foam inner layer 30. Thus, embodiments allow a user to have a large amount of control over pressure and/or vibration energy. Moreover, the thicknesses and pliability of the different layers of resilient material in device 10 may be selected for a desired level of applied pressure, energy transfer or comfort.

Figure 6:
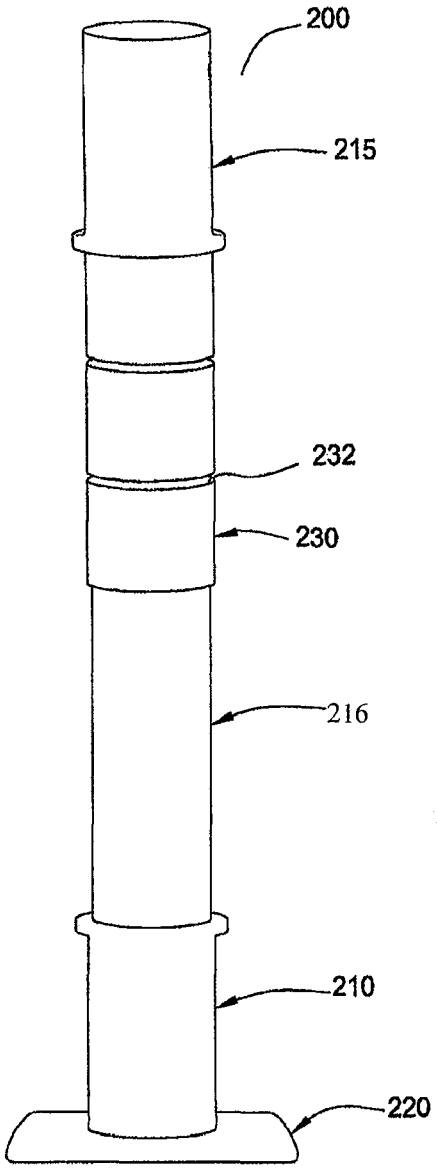
FIG. 6 depicts an elevation view of a massage device, according to another embodiment of the invention.
Figure 7:
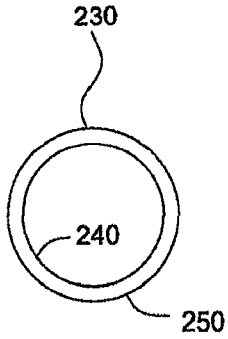
FIG. 7 depicts a cross-section view of a roller of the massage device shown in FIG. 6.

FIG. 6 shows an embodiment of a message device in the form of a massage stick 200. Massage stick 200 may also be configured as a rolling pin device, such as with rotatable components. The massage stick 200 may have hand grips 210 and 215 removeably connected to opposite ends of a shaft 216. A docking station 220 may be adapted to receive the device, in this case, on the side of hand grip 210. One or more sections of pliant material referred to as a knuckle 230 may be provided between hand grips 210 and 215. Knuckles 230 may also be referred to as rollers, rings, joints or bushings. Knuckles 230 may be configured, such as described above for FIG. 1, with one or more layers of pliant material over a hard spine. FIG. 7 shows a cross-section of an embodiment of a knuckle 230. In FIG. 7, a layer of pliant material 250 overlays a spine 240. As discussed previously in connection with FIG. 1, there may be one or more layers of pliant material 250 overlaying the spine 240, and the layers may vary in pliability. The layer of pliant material 250 may also comprise thin memory foam that serves as a bumper between the knuckle 230 and a person's skin.

In the embodiment shown in FIG. 6, multiple knuckles 230 are mounted on the shaft 216. If a rolling pin arrangement is used, a single roller may be mounted on the shaft 216 that extends between the hand grips 210 and 215. The knuckles 230 may individually rotate about the shaft 216. Although FIG. 6 illustrates a portion of the shaft 216 without knuckles 230, it is to be understood that knuckles 230 may cover the shaft 216 from end-to-end between the hand grips 210 and 215. Knuckles 230 may also be spaced apart slightly by a gap 232.

Figure 8:
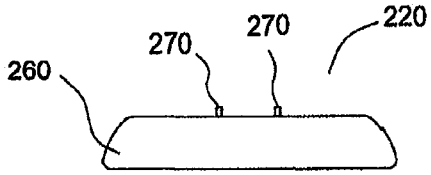
FIG. 8 depicts a side view of another embodiment of a message device charging station.

Additionally, one or more motors (not shown) may be placed inside the device, such as underneath the handgrips 210 and/or 215. One or more motors could also be placed inside the shaft 216 or knuckles 230. Handgrips 210 and 215, the shaft 216 and/or knuckles 230 may provide a housing for other components as well. The one or more vibration motors may allow for adjustable levels of vibration, or for turning vibration features on and off. Control features may be provided on either one or both of handgrips 210 and/or 215. Motor vibration may be controlled by a rotary feature on handgrip 210 and/or 215. For example, vibration levels may be changed by rotating the handgrip or a portion of the handgrip. Buttons or switches may also be provided, such as a thumb engagement switch. Docking station 220 may also serve as a charging station. FIG. 8 depicts a charging station 220 adapted to receive the massage stick 200. Charging station 220 comprises a base 260 and connectors 270 for electrical connection to rechargeable batteries housed inside the massage stick 200.

Figure 9:
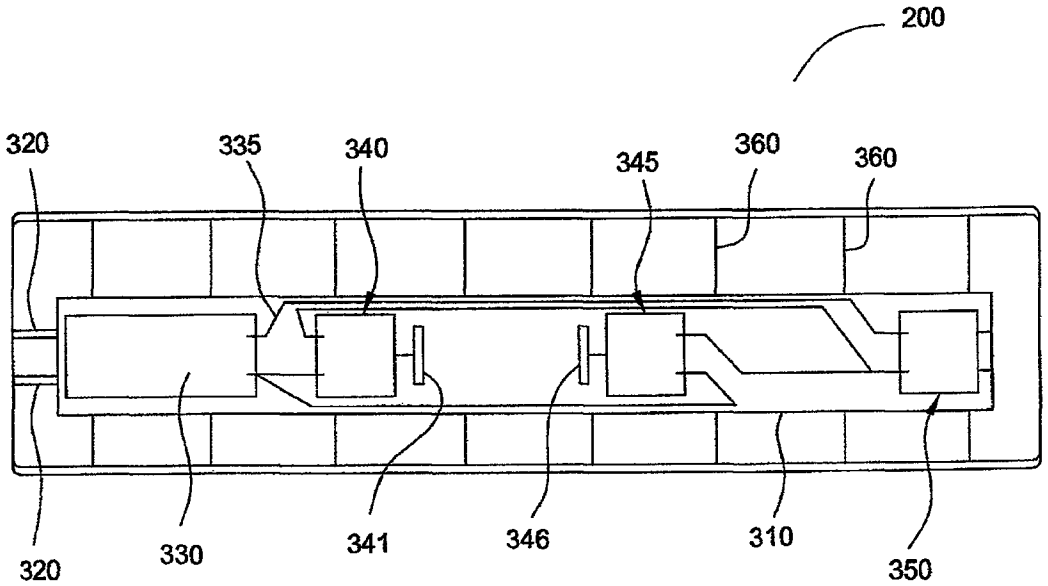
FIG. 9 depicts a section view of the massage device shown in FIG. 6, according to some embodiments.

FIG. 9 provides an internal, cross-section view of components that may be housed in the massage stick 200, according to some embodiments. A motor housing 310 may comprise the shaft 216 and/or portions of handgrips 210 and 215, as discussed above. At one end, electrical connections 320 are provided to one or more rechargeable batteries 330. Rechargeable battery 330 is electrically connected by wires 335 to one or more motor vibrators 340 and 345 and a control unit 350. Control unit 350 may comprise an off-on switch, a speed control or vibration control, or other desired functions. Motor vibrators 340 and 345 have impellers 341 and 346, respectively, which upon rotation create vibrations.

In one embodiment, motor vibrators 340 and 345 may comprise 25-volt motors. One or more motors may be used in the embodiments discussed herein. In the embodiment shown in FIG. 9, fins 360 are provided to redistribute energy more evenly through the pliant layers of the massage stick 200. As discussed above for FIG. 1, fins 360 may distribute energy to a relatively firm foam layer or inner core, which may be overlaid with a soft memory foam outer surface layer. When more than one motor vibrator is used, the different motors may be set to different layers of vibration. For example, a first motor may be set for a deep vibration, and a second motor may be set for a mild vibration. Preferably, the motor with milder vibration may be positioned closer to the center of the device for better energy distribution.

Figure 10:
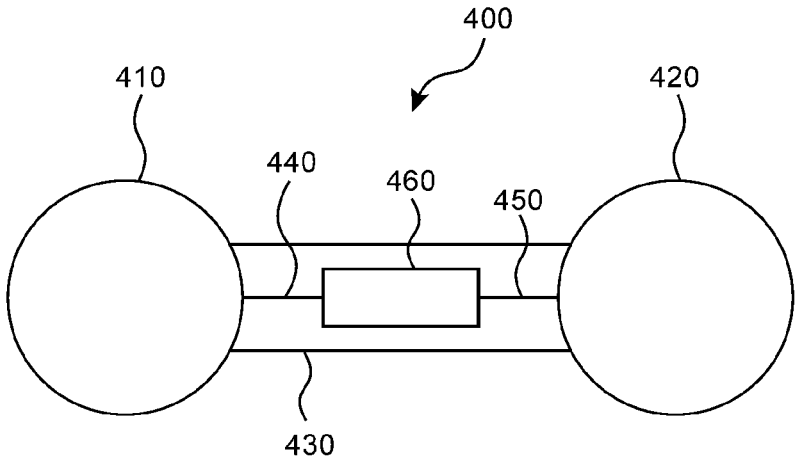
FIG. 10 depicts a plan view of another embodiment of a message device.
Figure 11:
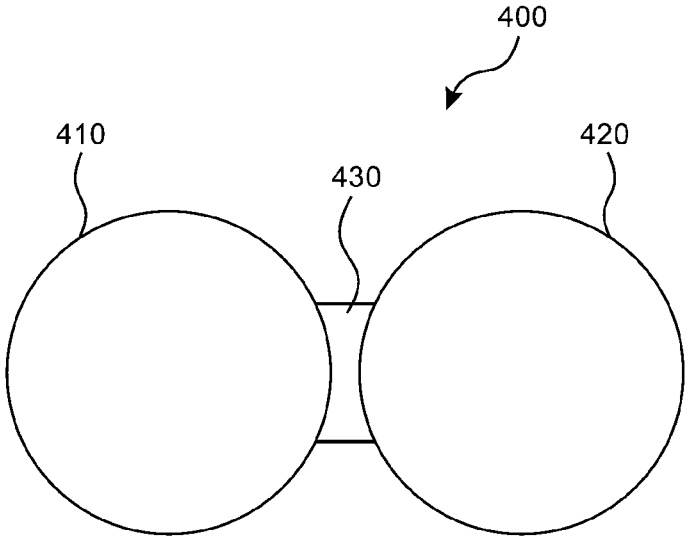
FIG. 11 depicts another plan view of the massage device shown in FIG. 10.

FIG. 10 illustrates a barbell configuration of a massage device 400. Massage balls 410 and 420 may be provided according to the embodiments discussed herein. The massage balls 410 and 420 may be mounted on opposite ends of a shaft 430 and may be adjustable from an outward position shown in FIG. 10 to an inward position shown in FIG. 11. The shaft 430 may also contain a motor housing 460 for components that create vibrations in the massage device 400. The shaft 430 may also serve as a handle or have user controls. Ports and/or charging connections may also be provided in the shaft 430. Vibrations may be created in massage ball 410 and/or massage ball 420. Connectors 440 and 450 provide electrical connections. Alternatively, vibrations may be transmitted mechanically from the shaft 430 to the massage balls 410 and 420 through connectors 440 and 450, respectively. Massage balls 410 and 420 and the shaft 430 may also be constructed out of a dense foam. The dense foam may surround a spine. Similar to other embodiments, components may be housed in the dense foam spine. Additionally, the massage balls 410 and 420 may include a rigid spine for transmitting vibration energy from the connectors 440 and 450, respectively. If components such as motors are housed in the shaft 430, the massage balls 410 and 420 may include a solid inner core instead of a hollow interior. Alternatively, components, such as motors, may be housed inside the dense foam without a spine. Such embodiments may be made by pouring material into a mold. Other embodiments discussed herein may similarly be made. The dense foam may also be layered with softer memory foam if desirable. Protrusions from the spine, such as fins or spokes, may also be utilized in massage balls 410 and/or 420 for energy or pressure transmission or adjustment.

The barbell configuration of massage device depicted in FIG. 10 may be especially useful in doing pressure-point work down a human spine. Having a barbell configuration may allow a person to do self-therapy laying on the floor by doing pressure-point work right down their spine. Thus, it may be preferable to configure the device so that it does not roll or to use the device in a manner so that it does not roll excessively.

Figure 12:
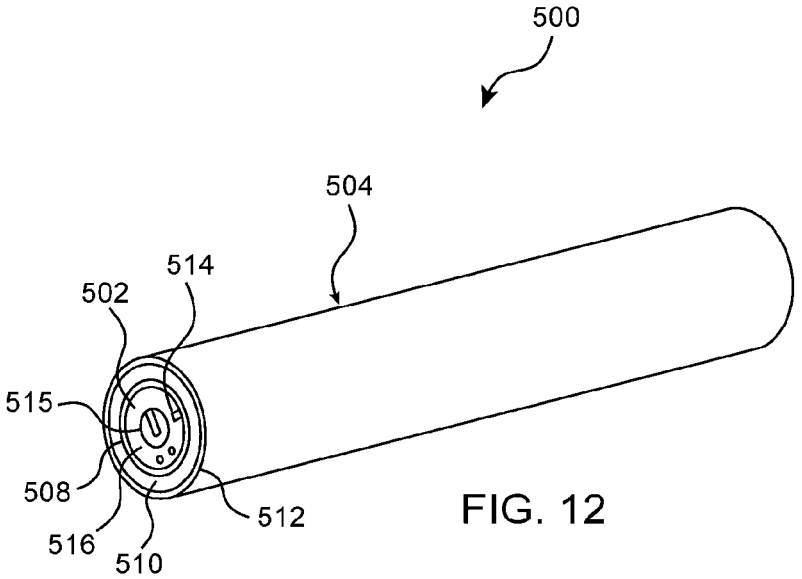
FIG. 12 depicts a perspective view of another embodiment of a massage device.
Figure 13:
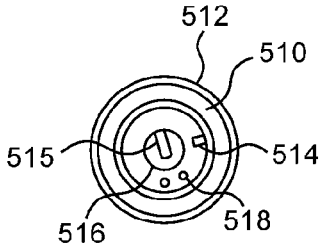
FIG. 13 depicts an end view of the massage device shown in FIG. 12.
Figure 14:
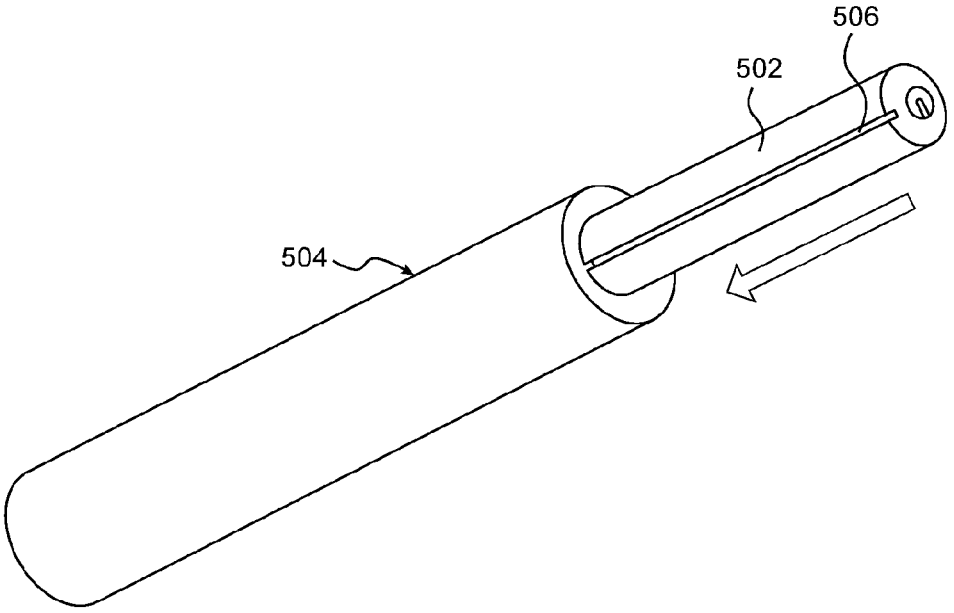
FIG. 14 depicts a partially exploded view of the massage device shown in FIG. 12.

Referring now to FIGS. 12-14, collectively, a massage device 500 is shown. The massage device 500 comprises a foam covered roller about 36 inches long and 6 inches in diameter. Such a device may be especially useful for working on a large muscle, such as a pulled hamstring, which may require a lot of pressure and/or energy to help release it when it is retracted. The need for assistance is even greater when a trainer is working on an athlete that may be very large, such as a football lineman. In such situations, the massage device 500 may be used to roll out the muscle. Further, adjustable vibrations may be applied to stimulate the muscle and to permit it to relax with less energy.

The massage device 500 may comprise a rigid elongate hollow shaft 502 and a removeable roller 504 keyed in concentric relationship to the shaft 502. The shaft 502 may include a longitudinal key slot 506 extending the length thereof. The roller 504 may include a hollow spine 508 covered by one or more layers of resilient material. In the embodiment of the massage roller 500 shown in FIGS. 12-14, the roller 504 includes an inner layer 510 of relatively dense resilient material covered by an outer layer 512 of more pliant resilient material. The hollow spine 508 may include an inwardly projecting longitudinal rib 514 extending the length thereof. The rib 514 is sized for receipt in the key slot 506 of the shaft 502. A plurality of protrusions, similar to the protrusions 45 and fins 360 discussed above with reference to FIGS. 1 and 9, respectively, may project from the spine 508 into the layer 510 of resilient material.

Multiple interchangeable rollers 504 may be provided for assembly on the shaft 502. The rollers 504 may include various combinations of resilient layers having different densities and pliability. A user may select a roller 504 having the desired resilience and pliability, align the rib 514 of the roller 504 with the key slot 506 of the shaft 502 and slide the shaft 502 into the roller 504. Alternatively, a roller 504 may be used without the shaft 502 and battery vibration pack to provide massage therapy.

The shaft 502 may house a battery vibrator pack similar to the battery pack described above with reference to FIG. 9. A vibration control switch 515, such as an on-off switch or a multi-speed control switch, operatively connected to the battery vibrator pack may be mounted on an end plate or cap 516 of the shaft 502. The shaft 502 may also house heating/cooling elements that may be controlled by a heating/cooling control switch 518 mounted on the end 516 of the shaft 502.

Figure 15:
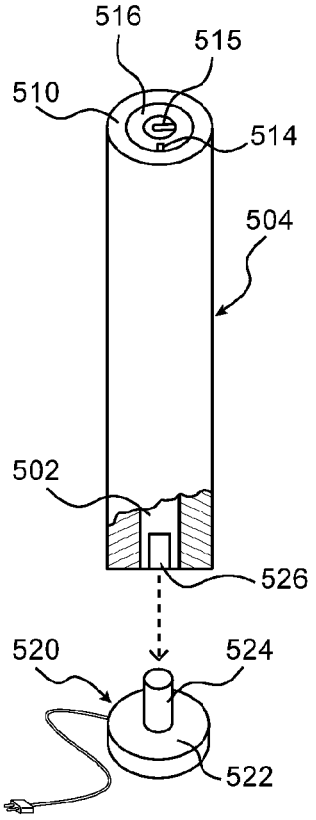
FIG. 15 is an exploded partially broken away view of the massage device shown in FIG. 12 and another embodiment of a massage device charging station.

The massage device 500 may be recharged by connecting the shaft 502 to a recharge docking station 520. The docking station 520, shown in FIG. 15, may include a base 522 and an upstanding charge post 524 connected to a power source. The shaft 502 may include a port 526 or other suitable connector at an end thereof sized to receive the charge post 524.

Figure 16:
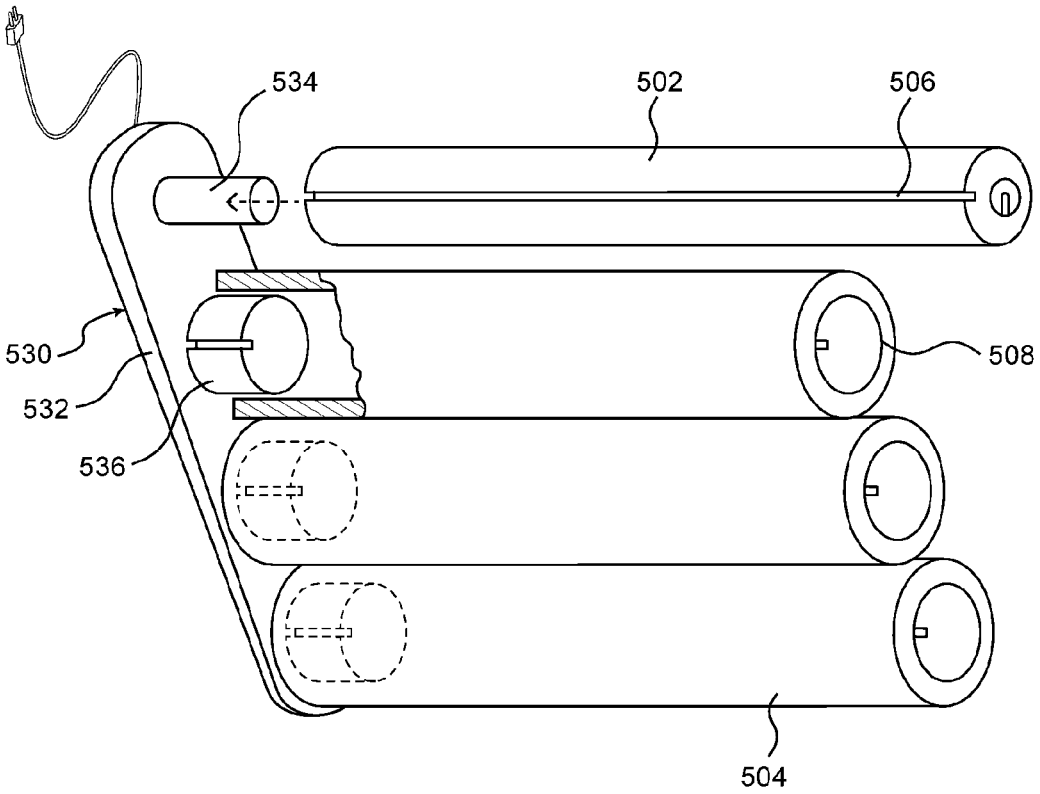
FIG. 16 is a partially exploded and partially broken away view depicting another embodiment of a massage device charging station adapted for storing multiple massage rollers.

An alternative docking station 530 is shown in FIG. 16. The docking station 530 may include a base 532 and an upstanding charge post 534 connected to a power source. The docking station may further include one or more docking posts 536 for holding and storing rollers 504. The rollers 504 may be arranged according to their resilience/pliability and texture. Additionally, the rollers 504 may be color coded to designate different resilience/pliability combinations for a user's quick and convenient selection.

Figure 17:
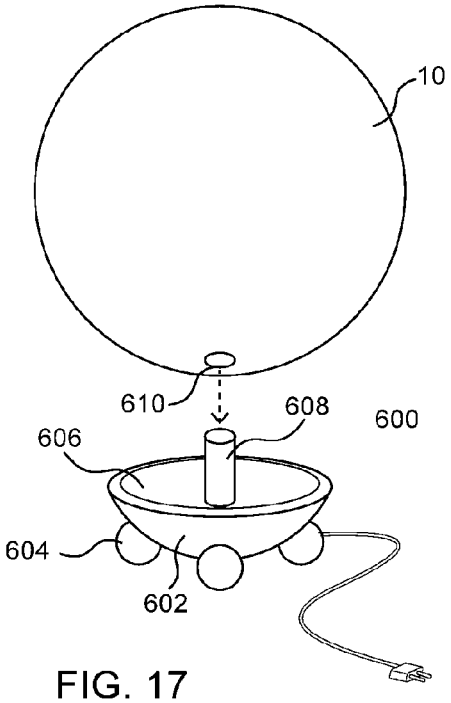
FIG. 17 depicts a perspective view of another embodiment of a massage device charging station adapted to receive a round-shaped massage device.
Figure 18:
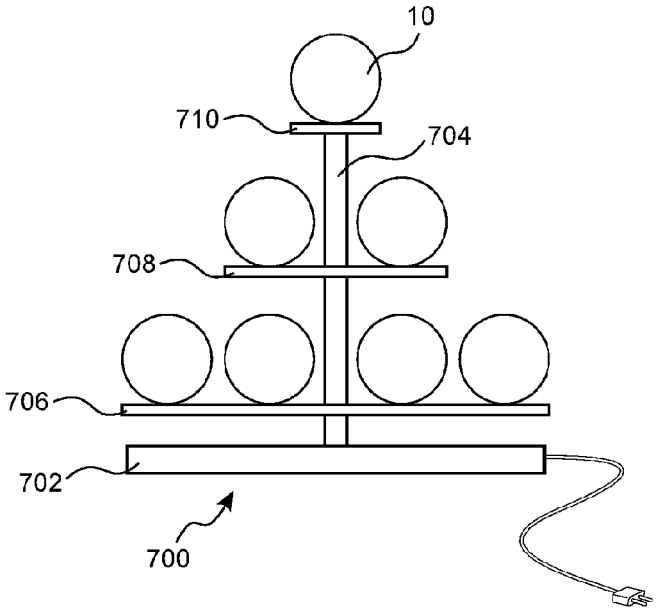
FIG. 18 depicts an elevation view of another massage device charging station adapted to charge and store multiple round-shaped massage devices.

Referring now to FIGS. 17 and 18, alternative docking stations are shown for the ball configuration massage device 10 described above with reference to FIG. 1. In FIG. 17, a docking station 600 may include a base 602 supported on a plurality of feet 604. The base 602 may include a concave inner surface 606 defining a bowl-like shape and an upstanding charge post 608 connected to a power source. The massage ball 10 may include a hole 610 sized to receive the charge post 608 and establish an electrical connection to recharge a battery vibration pack housed within the massage ball 10.

In FIG. 18, a docking station 700 may store and charge multiple massage balls 10. The docking station 700 may include a base 702 adapted to rest upon a substantially planar surface. A substantially vertically post 704 extends upward from the base 702 and supports one or more shelves vertically spaced above the base 702. In FIG. 18 three shelves 706, 708 and 710 are supported on the post 704. The shelves 706, 708 and 710 are oriented substantially parallel to each other and to the base 702. The docking station 700 may include multiple charge posts (not shown in the drawings) similar to the charge post 608 described above for establishing electrical connections to recharge a battery vibration pack that may be housed within the balls 10.

Figure 19:
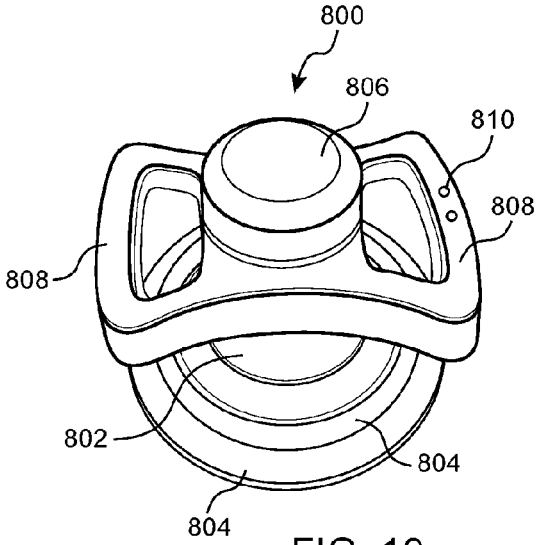
FIG. 19 depicts a perspective view of deep tissue massage device.

Referring now to FIG. 19, a deep tissue massage device 800 includes a substantially cylindrical body 802. The body 802 may house a motor and a shaft operatively connected to a motor. One or more massage pads 804 may be connected to the motor shaft. One or more of the massage pads 804 may include rigid fins of the type previously described herein aiding the transmission of vibration energy to the massaged tissue. A battery vibration pack 806 may be removeably attached to the housing 802. Upon attachment of the battery vibration pack 806, an electrical connection is established with the motor housed within the massage device 800. Actuation of the motor rotates the massage pads 804 in a substantially orbital manner to provide a deep tissue massage. Dual handles 808 mounted on the body 802 extending radially outwardly therefrom may be conveniently grasped by a user to control the pressure applied to the massaged tissue. Control switches 810 operatively connected to the battery vibration pack 806 may be mounted in the handles 808 for convenient access by a user.

Figure 20:
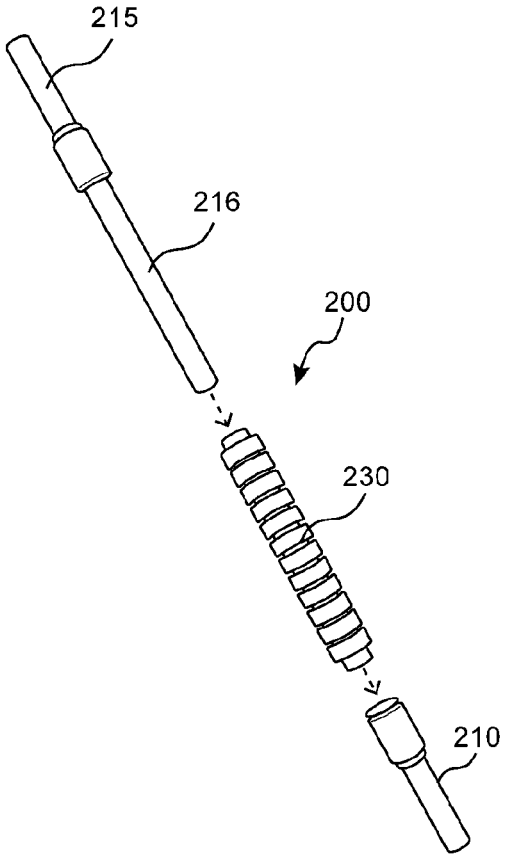
FIG. 20 is an exploded perspective view of a massage device depicting multiple rollers mounted on a massage stick.

In FIG. 20, an exploded view of the massage stick 200 is shown. As previously described above, the components of the massage stick 200 may be separated to facilitate convenient removal of the rollers 230 from the shaft 216 and replacing them with rollers 230 that have a different pliability formed by alternative combinations of pliant material layers. The arrangement of the rollers 230 on the shaft 216 may include rollers 230 having the same pliability or a combination of rollers 230 having different pliabilities. For example, the rollers 230 may be arranged so that the pliabilities of alternate rollers 230 are different. Likewise, the rollers 230 may be arranged on the shaft 216 in groups of two or more, each group of rollers 230 having different pliabilities.

Figure 21:
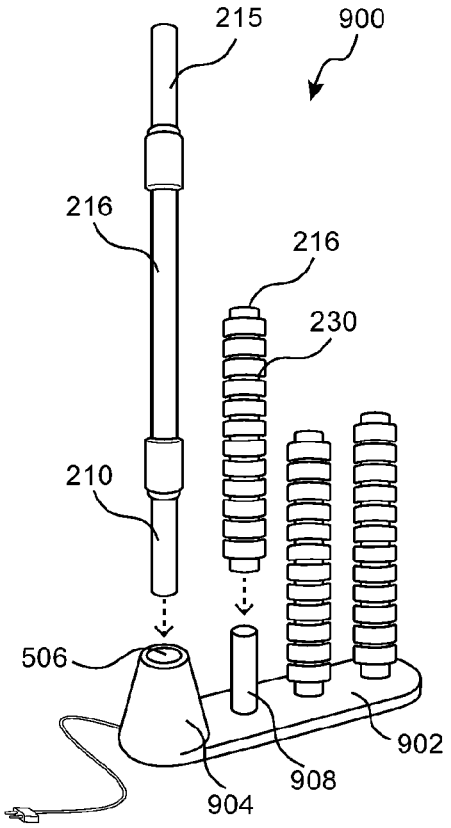
FIG. 21 is a partially exploded perspective view depicting another embodiment of a massage device charging station adapted for storing multiple massage sticks with rollers.

An alternative docking station 900 is shown in FIG. 21. The docking station 900 may include a base 902 and a charge port 904 connected to a power source. The charge port 904 may include a bore 906 sized to receive the charging hand grip 210. The docking station 900 may further include one or more docking posts 908 for holding and storing rollers 230 on multiple shafts 216. The rollers 230 may be arranged according to their resilience/pliability and texture and/or various combinations thereof. Additionally, the rollers 230 may be color coded to designate different resilience/pliability combinations for a user's quick and convenient selection.

While the foregoing is directed to embodiments of the present invention, other and further embodiments of the invention may be devised without departing from the basic scope thereof, and the scope thereof is determined by the claims that follow

What is claimed is:

1. A massage device comprising:

a hollow rigid core member;

at least one roller rotatably mounted on said core member; said at least one roller including a rigid spine;

a first layer of resilient material having a first density overlaying said spine;

a second layer of resilient material having a second density overlaying said first layer of resilient material; and a plurality of protrusions projecting outwardly from said spine into said first layer of resilient material.

2. The massage device of claim 1 wherein said core member comprises a hollow shaft housing at least one rechargeable battery operatively connected to at least one vibrating motor.

3. The massage device of claim 2 including a control interface operatively connected to said battery and said motor.

4. The massage device of claim 2 wherein said shaft includes a longitudinal slot extending the length thereof, and wherein said roller includes a longitudinal rib sized for receipt in said longitudinal slot of said shaft for securing said roller in concentric relationship with said shaft.

5. The massage device of claim 1 further including a docking station, wherein said docking station includes a base and a charge post connected to a power source, said core member including a port for electrical connection with said charge post.

6. The massage device of claim 5 wherein said base of said docking station includes a docking post for storing said roller while not in use.

7. The massage device of claim 6 wherein said base includes two or more docking posts.

8. The massage device of claim 1 wherein said protrusions extend substantially through said first layer of resilient material.

9. The massage device of claim 1 wherein said core member comprises a hollow elongated shaft.

10. The massage device of claim 2 including substantially spherical rollers mounted on opposite ends of said shaft.

11. The massage device of claim 10 wherein said rollers are adjustable inwardly and outwardly along said shaft.

12. The massage device of claim 2 including a plurality of rollers rotatably mounted on said shaft, wherein said rollers independently rotate about said shaft.

13. The massage device of claim 12 including a pair of handles removeably secured to the distal ends of said shaft, said rollers being disposed about said shaft between said handles.

14. The massage device of claim 1 further including a docking station, wherein said docking station includes a base and a substantially vertical support column mounted on said base, said column supporting one or more shelves vertically spaced apart and extending substantially parallel to said base, each of said shelves including one or more charge posts connected to a power source.

15. The massage device of claim 1, wherein said core member comprises a substantially cylindrical body housing a motor, a shaft operatively connected to said motor, said first and second layers of resilient material comprising message pads operatively connected to said shaft.

16. A massage device comprising:

a hollow shaft housing at least one rechargeable battery operatively connected to at least one vibrating motor;

at least one roller rotatably mounted on said shaft; said at least one roller including a rigid spine;

a first layer of resilient material having a first density overlaying said spine;

a second layer of resilient material having a second density overlaying said first layer of resilient material;

a plurality of protrusions projecting outwardly from said spine into said first layer of resilient material; and wherein said shaft includes a longitudinal slot extending the length thereof, and said roller includes a longitudinal rib sized for receipt in said longitudinal slot of said shaft for securing said roller in concentric relationship with said shaft.

* * * * *